US008558130B2

(12) United States Patent
Verdú Martínez et al.

(10) Patent No.: US 8,558,130 B2
(45) Date of Patent: Oct. 15, 2013

(54) PUSH-BUTTON SWITCH UNIT WITH A DISPLAY DEVICE

(75) Inventors: Juan José Verdú Martínez, Sant Boi de Llobregat (ES); Miguel Angel Lorenzo Riera, Santa Coloma de Cervelló (ES)

(73) Assignee: Industrias Lorenzo, S.A., Sant Climent de Lllobregat, Barcelona (ES)

( * ) Notice: Subject to any disclaimer, the term of this patent is extended or adjusted under 35 U.S.C. 154(b) by 122 days.

(21) Appl. No.: 13/363,715

(22) Filed: Feb. 1, 2012

(65) Prior Publication Data

US 2013/0026017 A1 Jan. 31, 2013

(30) Foreign Application Priority Data

Feb. 1, 2011 (ES) ..... 201100105 U

(51) Int. Cl.
*H01H 9/00* (2006.01)

(52) U.S. Cl.
USPC ..... 200/314

(58) Field of Classification Search
USPC ..... 200/310–314
IPC ..... H01H 13/023
See application file for complete search history.

(56) References Cited

U.S. PATENT DOCUMENTS

| | | | | |
|---|---|---|---|---|
| 4,908,485 | A * | 3/1990 | Honda et al. | 200/462 |
| 5,278,362 | A * | 1/1994 | Ohashi | 200/5 A |
| 7,060,922 | B2 | 6/2006 | Hoehne | |
| 7,943,875 | B2 * | 5/2011 | Chu | 200/293 |
| 8,129,640 | B2 * | 3/2012 | Liao | 200/314 |
| 8,378,246 | B2 * | 2/2013 | Chu | 200/520 |

FOREIGN PATENT DOCUMENTS

| | | |
|---|---|---|
| EP | 2053622 | 4/2009 |
| JP | 4002013 | 10/2007 |

* cited by examiner

*Primary Examiner* — Vanessa Girardi
(74) *Attorney, Agent, or Firm* — Hess Patent Law Firm LLC; Robert J. Hess

(57) ABSTRACT

Push-button switch unit with a display device that includes a display device (3) housed in a push-button casing (4, 5) movably housed in a base casing (1). The display device (3) has a luminous display area (21) on a support plate (22) asymmetric thereto. The push-button casing is asymmetric relative to a viewing window (23) thereof, through which the luminous display area (21) is visible. The base casing (1) has a side opening (15*a*) to accommodate the push-button casing without the latter protruding laterally. The base casing (1) has a frame (2) attached having a bevel (16) formed around an opening (14) aligned with the viewing window (23). The bevel (16) has regular width around the entire opening (14) and protrudes laterally a regular distance from all sides of the base casing (1).

12 Claims, 5 Drawing Sheets

PUSH-BUTTON SWITCH UNIT WITH A DISPLAY DEVICE

FIELD OF THE ART

The present invention relates to a push-button switch unit having a display device associated to a push-button assembly. The display device can be an organic light-emitting diode (OLED) arranged to display words and/or varying graphics. The push-button switch unit is useful, among other fields, in the field of arcade and vending machines.

BACKGROUND OF THE INVENTION

U.S. Pat. No. 7,060,922 describes a push-button switch that includes a casing, a switch supported in the casing, a push button movably supported in the casing and an organic light-emitting diode (OLED) display device supported in the casing so that it remains stationary when the push button moves relative to the casing and which is visible through the transparent cover of the push button. The push button actuates the switch when it moves relative to the casing. The organic light-emitting diode (OLED) display device is arranged to display words and/or varying graphics.

EP-A-2053622 discloses a push-button switch with a display device that comprises a switch assembly including a casing that has an opening in the top thereof and a cover covering the casing, a switching element housed in the switch assembly and a plunger protruding upwards through a cover opening, wherein the plunger is guided in an ascending and descending movement inside the switch assembly to actuate the switch. A push button covering the switch assembly is mechanically connected to the plunger, and inside the push button there is an organic light-emitting diode (OLED) display device attached to a support plate. El display device is electrically connected to the switch assembly by means of a flexible ribbon connector.

JP-A-4002013 describes a push-button switch that comprises an optical sensing device to detect the state of the switch. The push-button switch comprises a base body and a push button that moves relative to the base body when it is depressed. The push button has an opaque portion intercepting the luminous trajectory between two elements of the optical sensing device when the push button is depressed.

DISCLOSURE OF THE INVENTION

The present invention provides a push-button switch unit with a display device, comprising a base casing with a cavity and a frame attached to said base casing, wherein said frame has an opening in communication with said cavity and a bevel around said opening. A push-button assembly is movably housed in said cavity of the base casing. Said push-button assembly comprises a display device with a luminous display area mounted on a support plate having a connection portion extending laterally from one side of said luminous display area, and a push-button casing sized to house said display device.

Said push-button casing has a viewing window aligned with the opening of said frame and is sized to allow viewing through it the luminous display area. An electronic control circuit is supported in the push-button casing and is operationally connected to the display device, and a switch device is operationally connected to said electronic control circuit and arranged to be operated by a relative movement between the push-button assembly and the base casing.

The push-button casing has a protruding casing portion built-in extending laterally from one side of said viewing window, said protruding casing portion being sized to house said connection portion of the support plate of the display device. The base casing has a side opening sized to accommodate the protruding casing portion formed by the lower and upper push-button casing elements, the protruding casing portion not projecting laterally from the base casing, and said bevel of the frame has regular width around the entire opening and protrudes laterally a regular distance from all sides of the base casing.

As a result, although the display device has the support plate asymmetric relative to the luminous display area and the push-button casing is asymmetric relative to the viewing window, the side opening of the base casing, which is a characteristic of the push-button switch unit of the present invention, allows for the entire luminous display area, and only the luminous display area, to be visible through the viewing window and for both the frame and the base casing to be symmetric relative to the viewing window.

In an embodiment, the push-button casing is formed by a lower push-button casing element and an upper push-button casing element connected with each other, wherein said upper push-button casing element has said viewing window built-in, which is covered by a transparent cover movably fitting the opening of the frame and acting as a push button that is depressed by the user. Between the base casing and the push-button casing an elastic spring is arranged pushing the push-button casing towards an extended position. This way, by depressing the push button, the user pushes the push-button casing towards the compressed position against the elastic spring force to actuate the switch device.

The display device is preferably an organic light-emitting diode (OLED) display device arranged to display words or varying graphics. The support plate of the display device comprises one or more connectors on a side opposite the luminous display area, and the lower push-button casing element has one or more corresponding first connection openings built-in through which said connectors are accessible. The electronic control circuit has connecting pins that are connected to the one or more connectors of the display device. These connecting pins go through one or more passageways formed in a bottom wall of the base casing and through said one or more first connection openings of the lower push-button casing element.

Preferably, the electronic control circuit is mounted on a circuit board housed in a control casing formed by a lower control casing element and an upper control casing element. Said connecting pins of the electronic control circuit protrude from said control casing through one or more second connection openings formed in said upper control casing element. In addition, the push-button casing and said control casing are mechanically connected with each other by means of one or more tubular connecting members through whom the connecting pins of the electronic control circuit extend when they are connected to the one or more connectors of the display device. These tubular connecting members go through said passageways of the base casing with the capability of relative movement.

This way, the push-button casing, the control casing and all the components housed therein move jointly relative to the base casing when the push button is depressed. As a result, there is no relative movement between the display device and the electronic control circuit, so that the connections between both are not subject to strain or wear.

In an embodiment, the lower push-button casing element has a number of first tubular projections formed around the first connection openings and extending downwards from a bottom wall of the lower push-button casing element, and the upper control casing element has a number of second tubular projections formed around the second connection opening and extending upwards from a cover wall of the upper control casing element. These first and second tubular projections are mechanically connected to each other forming the tubular connecting members.

Said switch device, which in a preferred embodiment comprises an optical sensor, is mounted on the circuit board that is housed in the control casing. In a cover wall of the upper control casing element an actuator opening is formed, which is positioned relative to the switch device. The base casing comprises an actuator member that extends downwards from its bottom wall and is aligned with said actuator opening. When the push button is actuated, a movement is produced of the assembly formed by the push-button casing and the control casing mutually joined relative to the base casing, and the actuator member actuates the switch device through the actuator opening.

In addition, the electronic control circuit comprises one or more connectors mounted on the circuit board and the control casing comprises one or more openings in one or more side walls thereof through which said connectors are accessible.

BRIEF DESCRIPTION OF THE DRAWINGS

The above and other characteristics and advantages will be more fully understood from the following detailed description of an example embodiment with reference to the attached drawings, wherein.

DETAILED DESCRIPTION OF AN EXAMPLE EMBODIMENT

In the Figures, numeric reference 40 designates generally a push-button switch unit with a display device according to an embodiment of the present invention. Throughout this description, the terms "up," "down," "upper," "lower" and derivatives thereof are used in relation to a position in which the switch unit 40 and its components are portrayed in the Figures.

Figure 7:
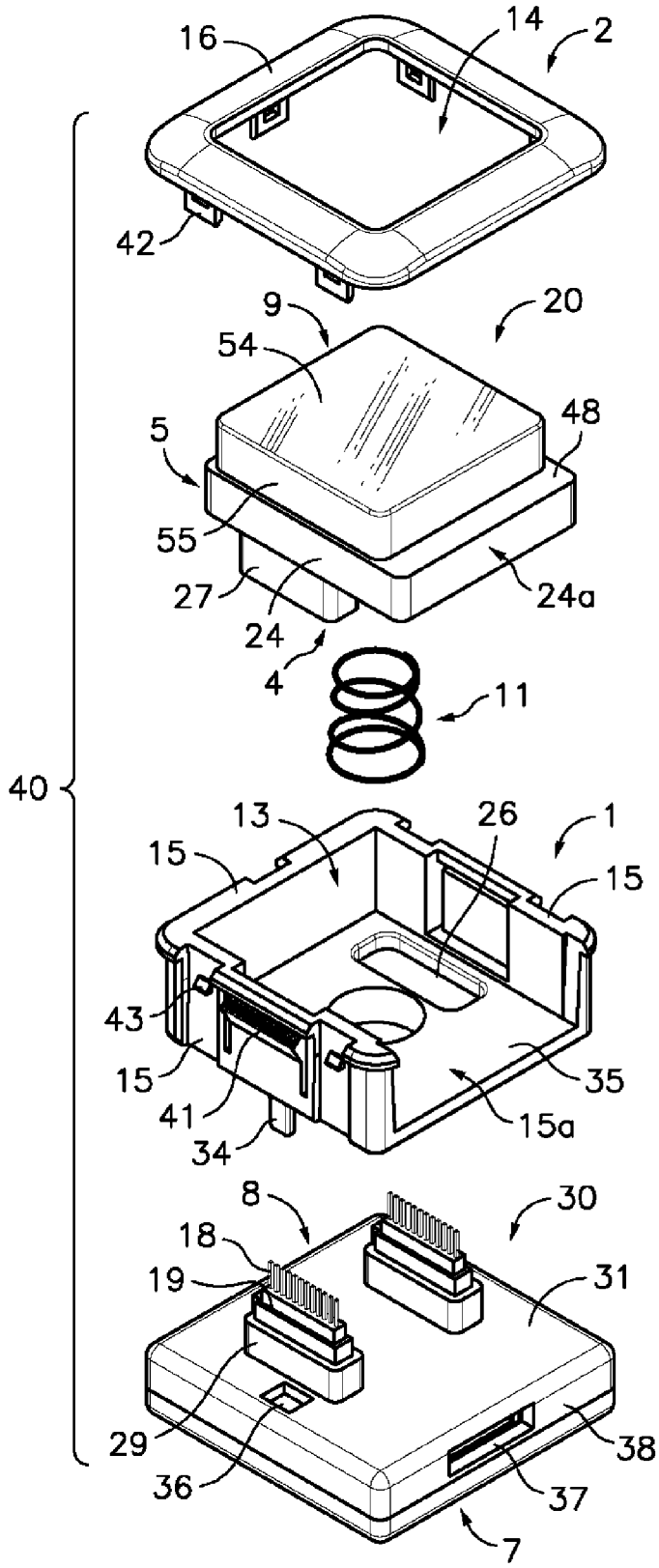
FIG. 7 is an exploded perspective view of the push-button assembly of FIG. 4, the control assembly of FIG. 6 and other components jointly forming the push-button switch unit.

As best shown in FIG. 7, the push-button switch unit 40 comprises a base casing 1, a frame 2, a push-button assembly 20, a control assembly 30 and an elastic spring 11. Said base casing 1 has a bottom wall 35 and side walls 15 defining a cavity 13. In an outer side of two of said opposite side walls 15 a number of elastic attachment tabs 41 are formed that are used for attaching the base casing 1 to a board (not shown) when the base casing is snap fitted in a custom-made opening in said board.

The frame 2 has in its bottom a number of elastic tabs 42 provided with openings engaging a number of fingers 43 projecting outwards from the side walls 15 of the base casing 1 for snap fitting the frame 2 to the base casing 1. The frame 2 has an opening 14 in communication with said cavity 13 of the base casing 1 and a bevel 16 surrounding said opening 14. Said bevel remains above the board when the frame 2 is attached to the base casing 1 and the latter is attached to the board. Said push-button assembly 20 is movably housed in said cavity 13 of the base casing 1 and is retained therein by the frame 2. Said elastic spring is arranged between the bottom wall 35 of the base casing 1 and the push-button assembly 20.

Figure 3:
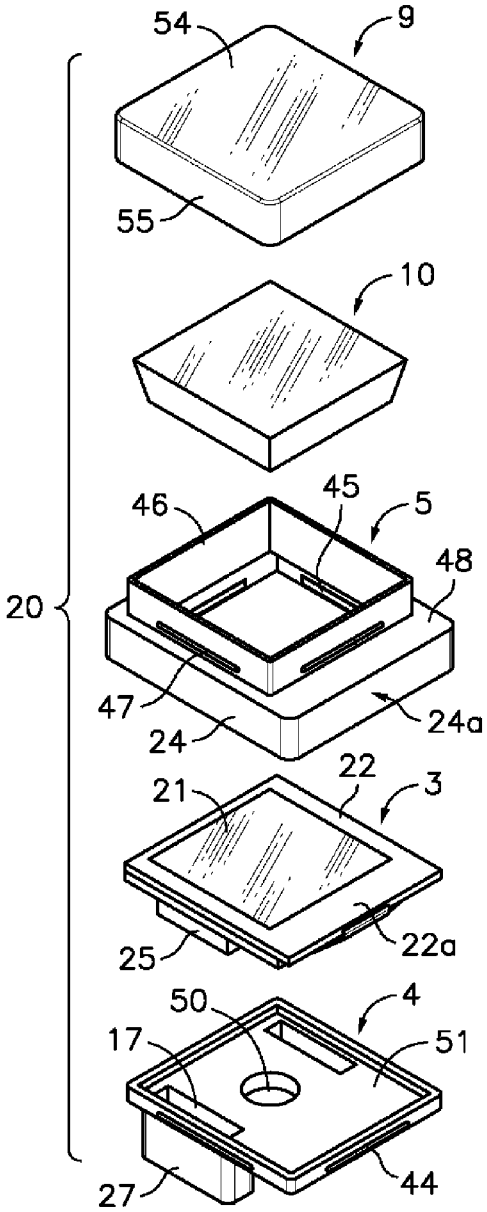
FIG. 3 is an exploded perspective view of several components forming a push-button assembly that forms part of the push-button switch unit.
Figure 4:
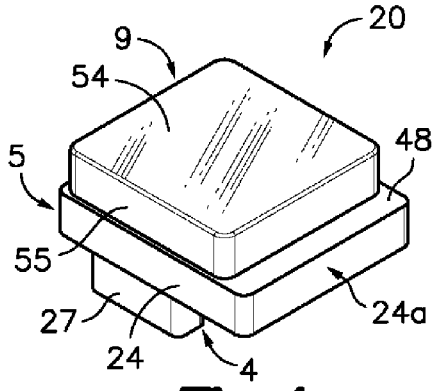
FIG. 4 is a perspective view of the push-button assembly formed by the assembled components of FIG. 3.

FIG. 3 shows a push-button assembly 20 with its components shown in explosion, which comprise a push-button casing formed by a lower push-button casing element 4 and an upper push-button casing element 5 connected to each other by respective snap locking elements 44, 45 and a display device 3, such as, for instance, an organic light-emitting diode (OLED) display device housed inside the push-button casing and arranged to display words or varying graphics. Said display device 3 has a luminous display area 21 mounted on a support plate 22, and this support plate 22 has a connection portion **22*a* extending laterally from one side of said luminous display area 21. As a result, the support plate 22 is asymmetric relative to the luminous display area 21**.

Said upper push-button casing element 5 has side walls 24 and a cover wall 48 wherein a viewing window 23 is formed aligned with the opening 14 of the frame 2 and through which the entire luminous display area 21, and only the luminous display area 21 of the display device 3, is visible. The push-button casing formed by the lower and upper push-button casing elements 4, 5 has a protruding casing portion **24*a* extending laterally from one side of said viewing window 23, and said protruding casing portion 24*a* is sized to house said connection portion 22*a* of the support plate 22 of the display device 3. As a result, the push-button casing formed by the lower and upper push-button casing elements 4, 5 is asymmetric relative to the viewing window 23**.

The push-button casing element 5 has button walls 46 formed around the viewing window 23. These button walls 46 extend upwards from said cover wall 48 and a transparent cover 9 is coupled thereto by means of respective snap locking elements 47 covering a viewing window 23. The transparent cover 9 has a cover wall 54 and a number of flaps 55 arranged on outer sides of the button walls 46. Said flaps 55 of the transparent cover 9 fit, with the possibility of movement, in the opening 14 of the frame 2. The button walls 46 have inner slanted surfaces wherein a transparent optical element 10 fits that is interposed between the luminous display area 21 of the display device 3 and the cover wall 54 of the transparent cover 9.

When the push-button assembly 20 is housed in the cavity 13 of the base casing 1 and is retained by the frame 2 (FIGS. 1, 2, 8, 9 and 10), the elastic spring 11 is compressed and has a lower end housed in a cavity 49 formed in the bottom wall 35 of the base casing 1 and an upper end arranged around a projection 50 formed in the bottom wall 51 of the lower push-button casing element 4, so that the elastic spring 11 pushes the push-button assembly 20 towards an extended position and the transparent cover 9 protrudes upwards from the bevel 16 of the frame 2 through the opening 14. Thus, the transparent cover 9 acts as a push button arranged to be depressed by a user, and when it is depressed by said user, the push button pushes the push-button casing towards a compressed position against the elastic spring 11 force.

The support plate 22 of the display device 3 comprises a couple of connectors 25 arranged on a side thereof opposing the luminous display area 21. The lower push-button casing element 4 has a number of connection openings 17 built-in through which said connectors 25 and corresponding first tubular projections 27 are accessible, the latter being formed around said first connection openings 17 and extending downwards from the bottom wall 28 of the lower push-button casing element 4. When the push-button assembly 20 is housed in the cavity 13 of the base casing 1 and is retained by the frame 2 (FIGS. 1, 2, 8, 9 and 10), said first tubular projections 27 are inserted in corresponding passageways 26 formed in the bottom wall 35 of the base casing 1.

Figure 1:
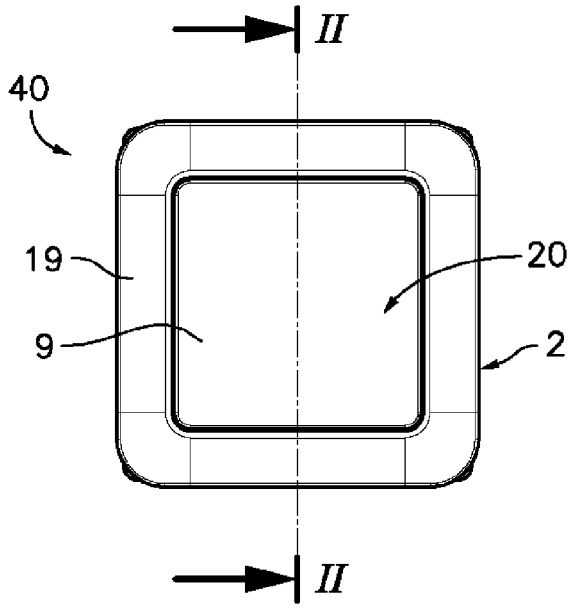
FIG. 1 is a plan view of a push-button switch unit with a display device according to an embodiment of the present invention.
Figure 2:
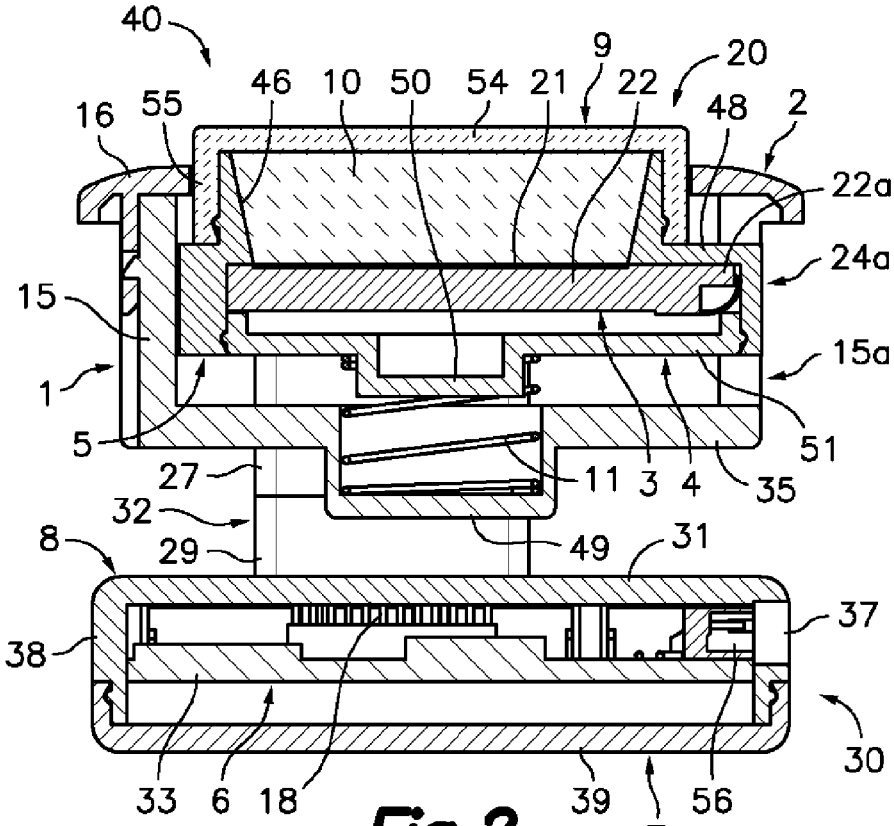
FIG. 2 is a cross-sectional view taken along the plane II-II of FIG. 1.
Figure 8:
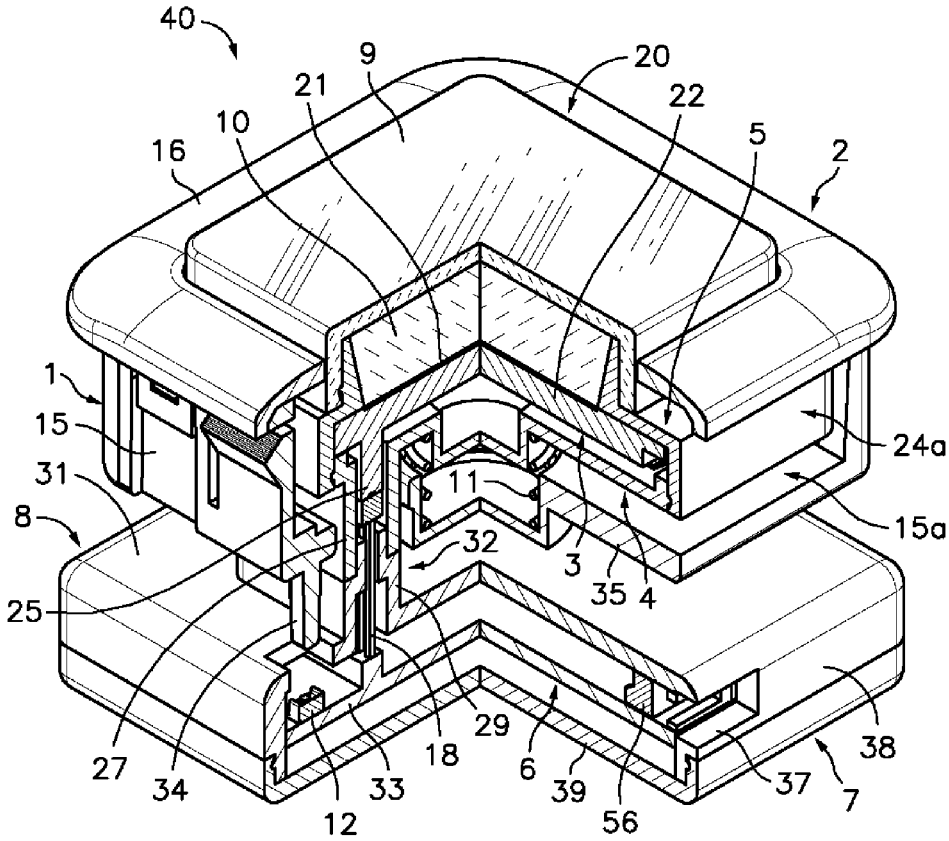
FIG. 8 is a partially sectional perspective view of the assembled push-button switch unit; y
Figure 9:
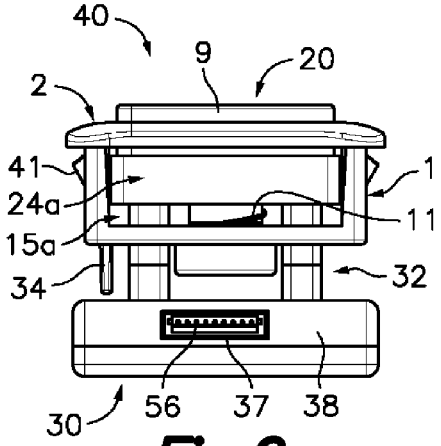
FIGS. 9 and 10 are side views of the push-button switch unit showing two adjacent sides thereof.
Figure 10:
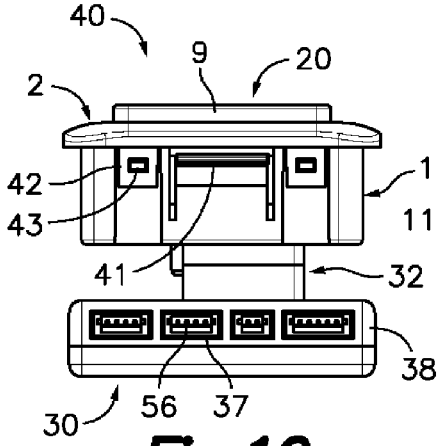

The base casing 1 has a side opening 15*a* sized to accommodate the protruding casing portion 24*a* formed by the lower and upper push-button casing elements 4, 5, the protruding casing portion 24*a* not projecting laterally from the base casing 1 (FIGS. 2 and 8). In addition, the bevel 16 of the frame 2 has regular width around the entire opening 14 (FIG. 1) and protrudes laterally a regular distance from all sides of the base casing 1 (FIGS. 9 and 10). Thus, the push-button switch unit 40 has a completely symmetric outer appearance relative to the luminous display area 21 of the display device 3 despite the support plate 22 being asymmetric relative to the luminous display area 21 and the push-button casing being asymmetric relative to the viewing window 23. In addition, the entire luminous display area 21, and only the luminous display area 21 of the display device 3, is visible through the transparent cover 9.

Figure 5:
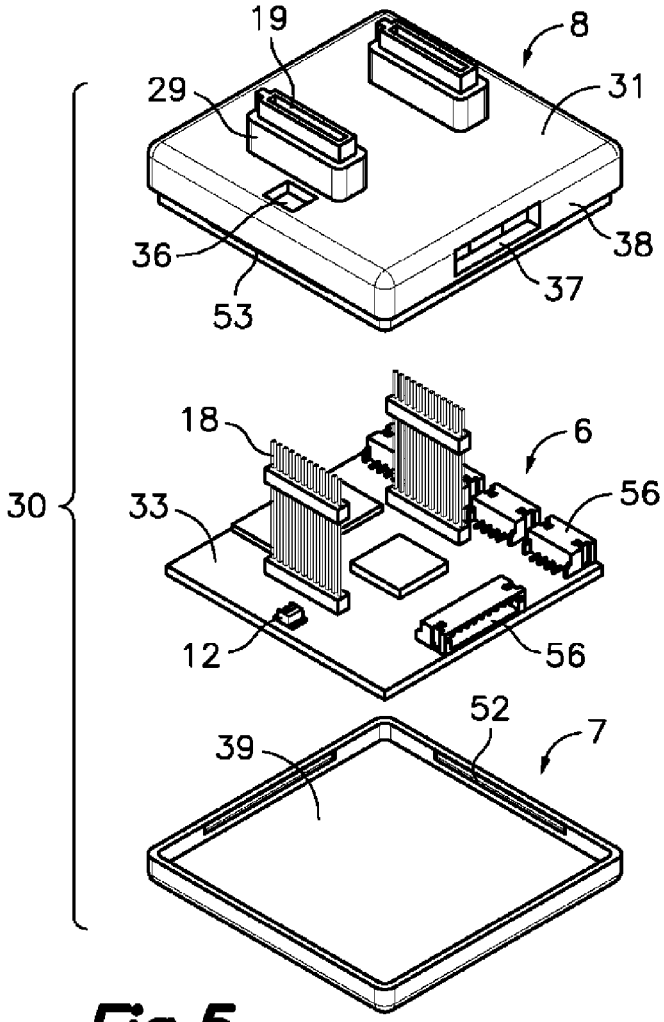
FIG. 5 is an exploded perspective view of several components forming a control assembly that forms part of the push-button switch unit.
Figure 6:
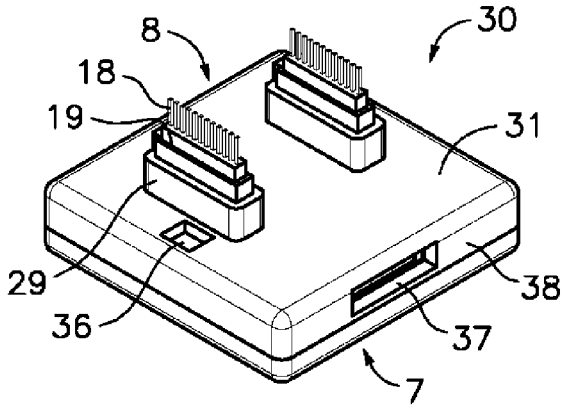
FIG. 6 is a perspective view of the control assembly formed by the assembled components of FIG. 5.

FIG. 5 shows said control assembly 30 with its components, shown in explosion, comprising a control casing formed by a lower control casing element 7 and an upper control casing element 8 connected to each other by respective snap locking elements 52, 53 and an electronic control circuit 6 housed inside the control casing. The electronic control circuit 6 is mounted on a circuit board 33 and it has connecting pins 18 extending upwards from said circuit board 33 and protruding from said control casing through a couple of second connection openings 19 formed in a cover wall 31 of the upper control casing element 8. In addition, the upper control casing element 8 has corresponding second tubular projections 29 formed around the second connection openings 19 and extending upwards from said cover wall 31.

The first tubular projections 27 of the push-button casing and said second tubular projections 29 of the control casing are configured so that they fit each other through their free ends forming tubular connecting members 32 mechanically connecting the push-button assembly 20 and the control assembly 30 with each other at the same time as the connecting pins 18 of the electronic control circuit 6 are inserted in the connectors 25 of the display device 3 and make contact therewith. Said tubular connections members 32 go through the passageways 26 of the base casing 1 with the capability of relative movement. Thus, when the push button is depressed, the push-button casing and the control casing move jointly relative to the base casing 1 while the electronic control circuit 6 remains operationally connected to the display device 3 without there being a relative movement between both.

This is so because the connecting pins 18 of the electronic control circuit 6 go through the second connection openings 19 of the upper control casing element 8, they are housed in the tubular connecting members 32 and, together with them, go through the couple of passageways 26 formed in the bottom wall 35 of the base casing 1, go through said first connection openings 17 of the lower push-button casing element 4 and are connected to the connector 25 of the display device 3.

Alternately, the push-button casing and the control casing might be mechanically connected by means of one or more connecting members different from the tubular connecting members 32 shown and described, whereas the connecting pins 18 of the electronic control circuit 6 might keep going through the second connection openings 19 of the upper control casing element 8, the passageways 26 formed in the bottom wall 35 of the base casing 1 and the first connection openings 17 of the lower push-button casing element 4 to connect to the connector 25 of the display device 3 with an equivalent result.

On the circuit board 33 there is mounted said switch device 12, which is operationally connected to the electronic control circuit 6 and arranged to be actuated by a relative movement between an actuating unit formed by the push-button assembly 20 and the control assembly 30 joined to each other and to the base casing 1. In the illustrated embodiment, the switch device 12 comprises an optical sensor, for instance, of the reflective type. In the cover wall 31 of the upper control casing element 8 an actuator opening 36 is formed located in an adequate position relative to the switch device 12. From the bottom wall 35 of the base casing 1 an actuator member 34 extends aligned with said actuator opening 36 of the control casing.

When the push button is depressed and said actuating unit formed by the push-button assembly 20 and the control assembly 30 linked to each other move relative to the base casing 1, the actuator member 34 of the base casing 1 interacts with the switch device 12 through the actuator opening 36 of the control casing to activate or deactivate the switch device 12.

The electronic control circuit 6 comprises one or more connectors 56 mounted on the circuit board 33 and positioned relative to two adjacent edges thereof. Consequently, the control casing comprises several openings 37 formed in two side walls 38 adjacent thereof, through which said connectors 56 (FIGS. 9 and 10) are accessible. Thus, several flexible connection power-supply and signal-transport cables (not shown) can be connected to the connectors 56 through said openings.

In the illustrated embodiment, said side walls 38 are formed in the upper control casing element 8, while the lower control casing element 7 basically defines a bottom wall 39. Nevertheless, said side walls 38 might alternatively be formed in the lower control casing element 7 with an equivalent result.

Modifications and variations of the shown and described embodiment will readily occur to a skilful artisan without departing from the scope of the present invention as defined in the attached claims.

What is claimed is:

1. A push-button switch unit with a display device comprising:

a base casing (1) with a cavity (13);

a frame (2) attached to said base casing (1), said frame having an opening (14) in communication with said cavity (13) and a bevel (16) around said opening (14);

a display device (3) with a luminous display area (21) mounted on a support plate (22) having a connection portion (22*a*) extending laterally from one side of said luminous display area (21);

a push-button casing movably housed in said cavity (13) of the base casing (1) and sized to house said display device (3), said push-button casing having a viewing window (23) aligned with the opening (14) of said frame (2) and being sized to allow viewing through it the luminous display area (21);

an electronic control circuit (6) supported in said push-button casing and operationally connected to the display device (3); and a switch device (12) operationally connected to said electronic control circuit (6) and arranged to be operated by a relative movement between the push-button casing and the base casing (1);

characterized in that:

the push-button casing forms a protruding casing portion (24*a*) extending laterally from one side of said viewing window (23), said protruding casing portion (24*a*) being sized to house said connection portion (22*a*) of the support plate (22) of the display device (3);

the base casing (1) has a side opening (15*a*) sized to accommodate the protruding casing portion (24*a*) formed by a lower and upper push-button casing elements (4, 5), the protruding casing portion (24*a*) not projecting laterally from the base casing (1); and said bevel (16) of the frame (2) has a width around the entire opening (14) and protrudes laterally a distance from all sides of the base casing (1).

2. The push-button switch unit according to claim 1, characterized in that said display device (3) is an organic light-emitting diode (OLED) display device arranged to display words or varying graphics.

3. The push-button switch unit according to claim 1 characterized in that said push-button casing comprises a lower push-button casing element (4) and an upper push-button casing element (5) connected with each other, wherein said upper push-button casing element (5) has said viewing window (23) built-in, which is covered by a transparent cover (9) fitting the opening (14) of the frame (2) and acting as a push button.

4. The push-button switch unit according to claim 3, characterized in that the support plate (22) of the display device (3) comprises at least one connector (25) on a side opposite the luminous display area (21), and the lower push-button casing element (4) has a first connection opening (17) built-in through which said connector (25) is accessible.

5. The push-button switch unit according to claim 4, characterized in that the electronic control circuit (6) has connecting pins (18) going through at least one passageway (26) formed in a bottom wall (35) of the base casing (1) and through said connection opening (17) of the lower push-button casing element (4), wherein said connecting pins (18) are connected to the connector (25) of the display device (3).

6. The push-button switch unit according to claim 5, characterized in that the electronic control circuit (6) is mounted on a circuit board (33) housed in a control casing formed by a lower control casing element (7) and an upper control casing element (8), wherein said connecting pins (18) of the electronic control circuit (6) protrude from said control casing through at least a second connection opening (19) formed in said upper control casing element (8).

7. The push-button switch unit according to claim 6, characterized in that the electronic control circuit (6) comprises one or more connectors (56) mounted on the circuit board (33) and the control casing comprises one or more openings (37) in one or more side walls (38) thereof through which said one or more connectors (56) are accessible.

8. The push-button switch unit according to claim 6, characterized in that said switch device (12) is mounted on said circuit board (33) and is driven by an actuator member (34) extending from the base casing (1) and interacting with the switch device (12) by means of an actuator opening (36) formed in the control casing.

9. The push-button switch unit according to claim 8 characterized in that the switch device (12) comprises an optical sensor.

10. The push-button switch unit according to claim 6, characterized in that said push-button casing and said control casing are mechanically connected with each other through at least one connection member.

11. The push-button switch unit according to claim 10, characterized in that said connection member is a tubular connection member (32) through which the connecting pins (18) of the electronic control circuit (6) extend when they are connected to the connector (25) of the display device (3), and said tubular connection member (32) goes through said passageway (26) of the base casing (1) with the capability of relative movement.

12. The push-button switch unit according to claim 11, characterized in that the lower push-button casing element (4) has a first tubular projection (27) formed around the first connection opening (17) and extending from a bottom wall (28) of the lower push-button casing element (4), and the upper control casing element (8) has a second tubular projection (29) formed around the second connection opening (19) and extending from a cover wall (31) of the upper control casing element (8), wherein said first and second tubular projections (27, 29) are mechanically connected to each other forming said tubular connection member (32).

* * * * *